US010186202B2

(12) United States Patent
Yin et al.

(10) Patent No.: US 10,186,202 B2
(45) Date of Patent: Jan. 22, 2019

(54) POWER SUPPLY CIRCUIT, ARRAY SUBSTRATE, AND DISPLAY DEVICE

(71) Applicant: BOE TECHNOLOGY GROUP CO., LTD., Beijing (CN)

(72) Inventors: Jingwen Yin, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 34 days.

(21) Appl. No.: 15/533,754

(22) PCT Filed: Dec. 16, 2015

(86) PCT No.: PCT/CN2015/097595
§ 371 (c)(1),
(2) Date: Jun. 7, 2017

(87) PCT Pub. No.: WO2016/110174
PCT Pub. Date: Jul. 14, 2016

(65) Prior Publication Data

US 2017/0330514 A1 Nov. 16, 2017

(30) Foreign Application Priority Data

Jan. 8, 2015 (CN) ..... 2015 1 0010133

(51) Int. Cl.
*G09G 3/3258* (2016.01)
*G09G 3/30* (2006.01)

(52) U.S. Cl.
CPC ..... *G09G 3/3258* (2013.01); *G09G 3/30* (2013.01); *G09G 2300/0819* (2013.01);
(Continued)

(58) Field of Classification Search
CPC ..... G09G 3/3258; G09G 3/30; G09G 2320/0223; G09G 2300/0819;
(Continued)

(56) References Cited

U.S. PATENT DOCUMENTS 9,875,686 B2 * 1/2018 Yin ..... G09G 3/3216
2008/0036697 A1 * 2/2008 Chung ..... G09G 3/3266 345/55

(Continued)

FOREIGN PATENT DOCUMENTS

CN 102916036 A 2/2013
CN 103927977 A 7/2014

(Continued)

OTHER PUBLICATIONS

Supplementary European Search Report for EP Application No. 15876674, dated Jul. 17, 2018, 12 pages.

(Continued)

*Primary Examiner* — Amit Chatly
(74) *Attorney, Agent, or Firm* — Armstrong Teasdale LLP

(57) ABSTRACT

The present disclosure provides a power supply circuit, an array substrate, and a display device. The power supply circuit includes a plurality of power wires, each providing a voltage to a row of pixel units. The plurality of power wires include at least a first power wire and a second power wire, between which at least one logical AND circuit is disposed. The logical AND circuit electrically econnects the first power wire with the second power wire when high level voltages are output by the first power wire and the second power wire simultaneously. As a result, voltages at connection points of two rows of power wires approximate to each other, voltage differences among different rows of pixel units are reduced, and therefore the phenomenon of luminance
(Continued)

nonuniformity in a display caused by different voltage drops of different rows of pixel units is improved.

19 Claims, 2 Drawing Sheets

(52) U.S. Cl.
CPC . *G09G 2310/0289* (2013.01); *G09G 2310/08* (2013.01); *G09G 2320/0223* (2013.01); *G09G 2320/0233* (2013.01)

(58) Field of Classification Search
CPC ... G09G 2320/0233; G09G 2310/0289; G09G 2310/08
See application file for complete search history.

(56) References Cited

U.S. PATENT DOCUMENTS

2009/0135110 A1* 5/2009 Nakamura ..... G09G 3/325 345/76
2010/0265234 A1* 10/2010 Fukuo ..... G09G 3/3614 345/211
2011/0291115 A1 12/2011 Kim et al.
2012/0062130 A1 3/2012 Ono

FOREIGN PATENT DOCUMENTS

| | | | |
|---|---|---|---|
| CN | 204117565 | U | 1/2015 |
| CN | 104361858 | A | 2/2015 |
| CN | 104505027 | A | 4/2015 |
| JP | 2004240156 | A | 8/2004 |
| JP | 2008122497 | A | 5/2008 |
| JP | 2008233400 | A | 10/2008 |
| JP | 2009116148 | A | 5/2009 |
| KR | 2007119200 | A | 12/2007 |

OTHER PUBLICATIONS

English Translation of PCT (CN) International Search Report, Application No. PCT/CN2015/097595, dated Mar. 1, 2016, 2 pps.
PCT (CN) Written Opinion, Application No. PCT/CN2015/097595, dated Mar. 1, 2016, 13 pps.: with English translation.
China First Office Action, Application No. 201510010133.1, dated May 26, 2016, 15 pps.: with English translation.

* cited by examiner

POWER SUPPLY CIRCUIT, ARRAY SUBSTRATE, AND DISPLAY DEVICE

CROSS REFERENCE TO RELATED APPLICATIONS

This patent application is a National Stage Entry of PCT/CN2015/097595 filed on Dec. 16, 2015, which claims the benefit and priority of Chinese Patent Application No. 201510010133.1 filed on Jan. 8, 2015, the disclosures of which are incorporated by reference herein in their entirety as part of the present application.

BACKGROUND

The present disclosure relates to the field of organic light-emitting display, and more particularly, to a power supply circuit, an array substrate, and a display device.

Currently, Organic Light-emitting Diode (OLED) display is a new and very popular flat panel display at home and abroad. The OLED display has characteristics of self light-emitting, wide viewing angle, short response time, high light-emitting efficiency, wide color gamut, low operating voltage, thin panel, being suitable for producing large-size and flexible panels, simple production process, and the like. The OLED display also has potential to be produced at low cost.

In an OLED display, a driving current is typically provided to a plurality of pixel units in a row through the same power wire. FIG. 1 is an exemplary schematic diagram of a power supply circuit. As shown in FIG. 1, a power supply VDD drives a plurality of active matrix organic light-emitting diodes (AMOLED) D1, D2, D3, and D4 through one power wire. The resistance symbols in FIG. 1 represent the equivalent resistance of each segment of the power wires.

When a row of pixel units all emit light, for example, when the organic light-emitting diodes D1, D2, D3, and D4 all emit light, in the power wire in the backplane of the display, the voltage at a position near the power supply VDD is higher than the voltage at a position far from the power supply VDD, due to the resistances of the power wires. This phenomenon is called voltage drop (IR drop). Due to the effect of voltage drop, the luminance of the pixel at the position near the power supply VDD is higher than that of the pixel at the position far from the power supply VDD. That is, if the light-emitting diodes D1, D2, D3, and D4 emit light simultaneously, since the light-emitting diode D1 is at a position near the power supply VDD, the voltage across the light-emitting diode D1 is larger and the luminance is higher.

When part of a row of pixel units emit light, for example, when the light-emitting diodes D1 and D4 emit light but the light-emitting diodes D2 and D3 do not emit light or the current flowing to D2 and D3 is extremely small (extremely weakly emitting light), the current flowing to the light-emitting diode D4 increases so that the light-emitting luminance of the light-emitting diode D1 is also different from that of the light-emitting diode D4.

Therefore, in display applications, in the above two cases, different light-emitting diodes will have a difference in luminance, resulting in nonuniform luminance and the occurrence of various traces (i.e. mura phenomenon) in a display.

FIG. 2 is a schematic diagram for explaining the phenomenon of nonuniform display luminance. In FIG. 2, each area may include a plurality of rows of pixel units. Area 2 is located at a position near the power supply VDD, and area 4 is located at a position far from the power supply VDD. In combination with FIG. 1, it is assumed that the area 2 includes a light-emitting diode D1, the area 3 includes light-emitting diodes D2, D3, and the area 4 includes a light-emitting diode D4. And it is assumed that the pixel units in the area 1 all emit light, namely, the area 1 is a light-emitting area. It is also assumed that the light-emitting diode D1 in the area 2 emits light, and then the area 2 is a light-emitting area. The light-emitting diodes D2 and D3 in the area 3 do not emit light, and then the area 3 is a dark area. The light-emitting diode D4 in the area 4 emits light, and then the area 4 is a light-emitting area.

According to the above described analysis, in FIG. 2, the pixel units in the area 1 all emit light. However, due to the presence of resistance of the power wire, the light-emitting luminance of the area 1 gradually decreases from the position near the power supply VDD to the position far from the power supply VDD. In addition, since the area 3 is dark, the area 2 is brighter than the area 1, and the area 4 is higher in the light-emitting luminance than the area 1 due to the larger incoming current. This will lead to the phenomenon of nonuniform light-emitting luminance in the display.

BRIEF DESCRIPTION

A power supply circuit, an array substrate, and a display device provided in embodiments of the present disclosure can improve the phenomenon of nonuniform luminance due to the difference in voltage drops between different rows of pixel units in a display.

One aspect of the present disclosure provides a power supply circuit including a plurality of power wires. Each of the plurality of power wires is configured to provide a voltage to a row of pixel units. The plurality of power wires at least include a first power wire and a second power wire, and at least one logical AND circuit is provided between the first power wire and the second power wire. The logical AND circuit electrically is configured to connect the first power wire with the second power wire when the first power wire and the second power wire output high level voltages simultaneously.

In embodiments of the present disclosure, the logical AND circuit includes a first transistor and a second transistor. A control electrode of the first transistor is connected to the second power wire, a first electrode of the first transistor is connected to the first power wire, and a second electrode of the first transistor is connected to a first electrode of the second transistor. A control electrode of the second transistor is connected to the first power wire, and a second electrode of the second transistor is connected to the second power wire.

In embodiments of the present disclosure, the first transistor and the second transistor are N-type transistors.

In embodiments of the present disclosure, the voltage output from the power wire is switched between a high level and a low level.

In embodiments of the present disclosure, the first power wire and the second power wire are adjacent to each other.

In embodiments of the present disclosure, at least one logical AND circuit is provided between every two adjacent power wires.

In embodiments of the present disclosure, connection points connecting the logical AND circuit with the first power wire and the second power wire are respectively located at positions on the first power wire and the second power wire far from a power supply.

In embodiments of the present disclosure, a plurality of logical AND circuits are provided between the first power wire and the second power wire, and a plurality of connection points connecting the plurality of logical AND circuits with the first power wire and the second power wire are provided on the first power wire and the second power wire at intervals.

Another aspect of the present disclosure provides an array substrate including any of the power supply circuits described above.

Still another aspect of the present disclosure provides a display device including the above-described array substrate.

The power supply circuit according to embodiments of the present disclosure provides a logical AND circuit between two power wires. The two power wires are electrically connected to each other while they simultaneously output high level voltages, such that the voltages at the connection points of the two power wires approximate to each other. The voltage difference between different rows of pixel units is reduced, thereby improving the phenomenon of nonuniform luminance in a display due to the difference in voltage drops between different rows of pixel units. The structure is simple and the cost is low.

BRIEF DESCRIPTION OF THE DRAWINGS

In order to more clearly illustrate the technical solutions of the embodiments of the present disclosure, the drawings of the embodiments will be briefly described below. It should be appreciated that the drawings described below merely relate to some embodiments of the present disclosure rather than limiting the present disclosure, in which.

DETAILED DESCRIPTION

To make the technical solutions and advantages of the embodiments of the present disclosure clearer, the technical solutions of the embodiments of the present disclosure will be clearly and completely described below in conjunction with the drawings. The embodiments described are part of the embodiments of the present disclosure, instead of all the embodiments. On the basis of the described embodiments of the present disclosure, all other embodiments obtained by those skilled in the art without creative work also fall within the scope of protection sought for by the present disclosure.

Unless otherwise defined, the technical terms or scientific terms used herein should have the common meaning understood by those of ordinary skill in the art to which this disclosure pertains. The "first", "second" or a similar word used in the description and claims of the present disclosure does not denote any order, quantity or importance, but is intended merely to distinguish different components. Similarly, "one", "a/an", "this" or a similar word does not represent a quantity limitation, but rather represents that there is at least one. The "comprise", "include" or a similar word means that the element or object preceding the word covers the element or object listed after the word and equivalents thereof, without excluding other element or object. The "upper", "lower" or a similar word is used only to represent the relative positional relationship, and the relative positional relationship may be changed accordingly when the absolute position of the object to be described changes. The "connection" is not limited to a specific form of connection, but can be a direct connection, an indirect connection via other component, a non-detachable connection, a detachable connection, an electrical or signal connection, or a mechanical or physical connection.

Figure 1:
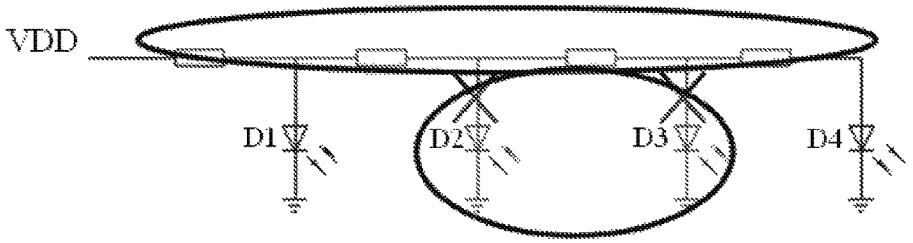
FIG. 1 is an exemplary schematic diagram of a power supply circuit.
Figure 2:
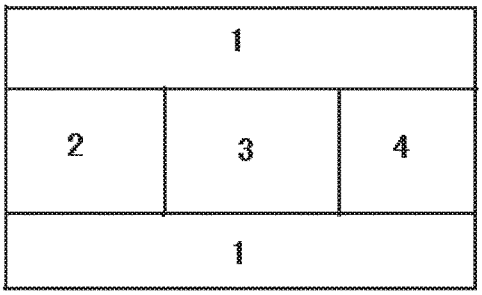
FIG. 2 is a schematic diagram for explaining the phenomenon of nonuniform luminance in a display.
Figure 3:
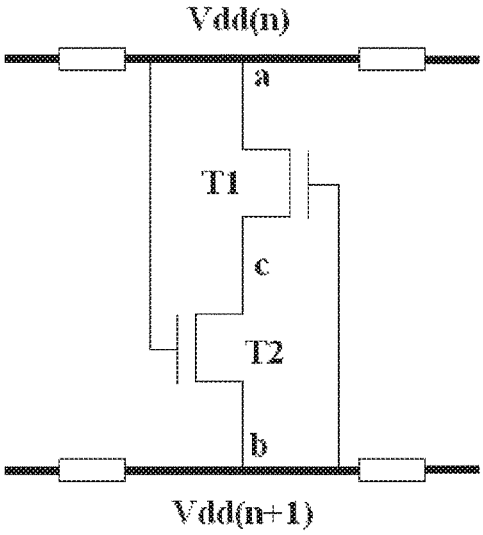
FIG. 3 is a schematic diagram of a power supply circuit according to an embodiment of the present disclosure.

FIG. 3 is a schematic diagram of a power supply circuit according to an embodiment of the present disclosure. As shown in FIG. 3, the power supply circuit of the present embodiment includes a plurality of power wires. Each of the plurality of power wires provides a voltage to a row of pixel units. The plurality of power wires include at least a first power wire n and a second power wire n+1, and at least one logical AND circuit is provided between the first power wire n and the second power wire n+1. The logical AND circuit electrically connects the first power wire n and the second power wire n+1 when the first power wire n and the second power wire n+1 output high level voltages simultaneously.

In the present embodiment, when the voltages output from the first power wire n and the second power wire n+1 both are high level, the first power wire n and the second power wire n+1 are electrically connected to each other. The voltages at the two connection points connecting the first power wire n and the second power wire n+1 with the logical AND circuit approximate to each other (it is difficult to be exactly the same due to the presence of resistance in components constituting the logical AND circuit). Thus, the driving voltage of the pixel units connected to the first power wire n approaches the driving voltage of the pixel units connected to the second power wire n+1. Therefore, the problem that the voltage drops between different rows of pixel units are greatly different due to the small current in some pixel units in one of the rows is improved, and further, the phenomenon of nonuniform luminance generated due to the difference in voltage drops between different rows of pixel units in a display is improved.

As shown in FIG. 3, the logical AND circuit includes a first transistor T1 and a second transistor T2. In general, the first transistor T1 and the second transistor T2 may be thin film transistors TFTs with small noise and small power consumption, and may be formed in the same process together with other thin film transistors on the array substrate. For example, the first transistor T1 and the second transistor T2 may be N-type thin film transistors TFTs, in which a control electrode is the gate, a first electrode is the drain, and a second electrode is the source. It will be appreciated by those skilled in the art that the P-type thin film transistor may also be used for the first transistor T1 and the second transistor T2. In this case, an inverter can be added at the gates of the first transistor T1 and the second transistor T2.

The gate of the first transistor T1 is connected to the second power wire n+1, the drain of the first transistor T1 is connected to the first power wire n, and the source of the first transistor T1 is connected to the drain of the second transistor T2. The gate of the second transistor T2 is connected to the first power wire n, and the source of the second transistor T2 is connected to the second power wire n+1.

The gate of the first transistor T1 and the source of the second transistor T2 are connected at the point b on the second power wire n+1, the drain of the first transistor T1 and the gate of the second transistor T2 are connected at the point a on the first power wire n, and the source of the first transistor T1 and the drain of the second transistor T2 are connected at the point c.

In the present embodiment, the connection points connecting the logical AND circuit with the first power wire n and the second power wire n+1 are respectively located at the positions on the first power wire n and the second power wire n+1 which are far from the power supply VDD. It can be understood that if the power supply VDD is located at one end of the power wires, the connection points a and b connecting the logical AND circuit with the first power wire n and the second power wire n+1 are located at the other end of the first power wire n and the second power wire n+1 far from the power supply VDD. Therefore, when the logical AND circuit is turned on, the voltages at positions on the two power wires far from the power supply VDD may be the same. As described in the background art, the farther from the power supply VDD, the worse the display luminance nonuniformity is. Therefore, making the voltages on the two power wires far from the power supply VDD approximate to each other can better improve the phenomenon of nonuniform display luminance generated due to the difference in voltage drops between different rows of pixel units.

It should be noted that the description of the present embodiment does not limit the specific positions of the points a and b, and the specific positions of the points a and b may be set according to actual needs.

Figure 4:
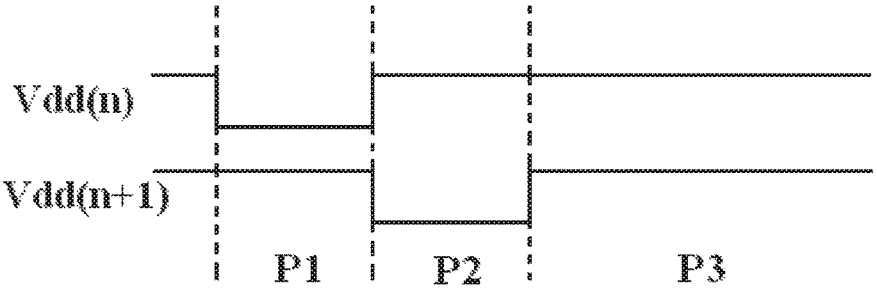
FIG. 4 is a timing chart of the voltage output from the power wire in the embodiment shown in FIG. 3.

FIG. 4 is a timing chart of the voltages output from the power wires in the embodiment shown in FIG. 3. FIG. 4 shows the operating waveforms of the voltages output from the first power wire n and the second power wire n+1. As shown in FIG. 4, the timing of the voltages output from the first power wire n and the second power wire n+1 includes three phases: P1 phase, P2 phase, and P3 phase.

Hereinafter, the timing of the voltages output from the power wires in the power supply circuit of the present embodiment will be described still with reference to the case wherein the first transistor T1 and the second transistor T2 are N-type transistors.

In the P1 phase, the voltage Vdd (n) output from the first power wire n is at a low level, and the voltage Vdd (n+1) output from the second power wire n+1 is at a high level. Therefore, the gate of the first transistor T1 is at a high level, and the drain of the first transistor T1 is at a low level. In this case, the first transistor T1 is in the ON state, and the voltage Vc at the point c approximates to the voltage Va at the point a, and both are at a low level. Also, the gate of the second transistor T2 is at a low level, and the source of the second transistor T2 is at a high level. In this case, the second transistor T2 is in the OFF state, so that the first power wire n and the second power wire n+1 are not electrically connected. The first power wire n can be used to complete a compensation operation.

In the P2 phase, the voltage Vdd (n) output from the first power wire n is at a high level and the voltage Vdd (n+1) output from the second power wire n+1 is at a low level. Therefore, the gate of the first transistor T1 is at a low level, and the drain of the first transistor T1 is at a high level. In this case, the first transistor T1 is in the OFF state. Also, the gate of the second transistor T2 is at a high level, and the source of the second transistor T2 is at a low level. In this case, the second transistor T2 is in the ON state, and the voltage Vc at the point c approximates to the voltage Vb at the point b, and both are at a low level. There is no electrical connection between the first power wire n and the second power wire n+1. The second power wire n+1 may be used to complete a compensation operation.

In the P3 phase, the voltages output from the first power wire n and the second power wire n+1 both are at a high level. In this case, the first transistor T1 and the second transistor T2 both are in the ON state, and the voltage Vc at the point c approximates to the highest voltage among the two points a and b. The first power wire n is electrically connected to the second power wire n+1. The voltages at the connection points connecting the first power wire n and the second power wire n+1 with the logical AND circuit approximate to each other, thereby improving the phenomenon of nonuniform luminance generated due to the difference in voltage drops between different rows of pixel units in a display.

It should be noted that although in this example, the case of one logical AND circuit has been described, it will be understood by those skilled in the art that the present embodiment does not limit the number of logical AND circuits, which may be more than one. When a plurality of logical AND circuits are provided between the first power wire n and the second power wire n+1, the connection points connecting the plurality of logical AND circuits with the first power wire n and the second power wire n+1 are set at intervals on the first power wire n and the second power wire n+1. Therefore, in the light-emitting phase, the voltages of the first power wire n and the second power wire n+1 at a plurality of positions approximate to each other so that the driving voltages of the light-emitting diodes between different rows of pixel units approximate to each other more, whereby the displaying is more uniform.

In the present embodiment, the voltage output by each power wire can be switched between the high level and the low level in the light-emitting phase. As will be known to those skilled in the art, switching to the low level is generally performed to achieve compensation or other function. When the voltage output from the first power wire n or the second power wire n+1 is at a low level, since the transistors constituting the logical AND circuit are turned off, there is no electrical connection between the first power wire n and the second power wire n+1. Because the first power wire n and the second power wire n+1 are not electrically connected, the first power wire n or the second power wire n+1 can be used for the completion of the normal compensation action, without affecting the compensation and other function performed at the low level.

The first power wire n and the second power wire n+1 may be two adjacent power wires. The first power wire n and the second power wire n+1 are electrically connected when the voltages output both are at a high level, preventing crosstalk between the adjacent two power wires.

In general, there are a plurality of rows of pixel units, whereby the power supply circuit in the present embodiment includes a plurality of power wires. The first power wire n and the second power wire n+1 above described are examples thereof, representing any two power wires. A logical AND circuit can be provided between every adjacent two power wires in all the power wires, such that the power wires form a network structure, to avoid the phenomenon of nonuniform display luminance caused by the difference in voltage drops between different rows of pixel units, and to solve crosstalk between adjacent power wires.

Another embodiment of the present disclosure further provides an array substrate including any of the power supply circuits of the above embodiments, and since the structure and principle of the power supply circuit have been sufficiently described above, they will not be described in detail herein.

The array substrate of the present embodiment improves the problem of nonuniform light-emitting luminance between different rows of pixel units, thereby improving the display uniformity of the light-emitting device.

Another embodiment of the present disclosure further provides a display device including an array substrate in the above described embodiment. The display device may be any product or component that has a display function, such as electronic paper, mobile phone, tablet, television, notebook computer, digital photo frame, navigator, and the like. Although the present disclosure has been described with an OLED display device as an example, it will be understood by those skilled in the art that the disclosure can be effectively applied to a display component having the phenomenon of nonuniform luminance generated due to the difference in voltage drops between different rows of pixel units.

The display device of the present embodiment improves the problem of nonuniform light-emitting luminance between different rows of pixel units, thereby improving the display uniformity of the light-emitting component.

It may be understood that the above embodiments are merely exemplary embodiments for the purpose of illustrating the principles of the present disclosure, but the present disclosure is not limited thereto. Those of ordinary skill in the art may make various alterations and improvements without departing from the spirit and essence of the present disclosure, which are also considered to be within the scope of protection sought for by the present disclosure.

What is claimed is:

1. A power supply circuit comprising a plurality of power wires; wherein each of the plurality of power wires is configured to provide a voltage to a row of pixel units; wherein the plurality of power wires comprise at least a first power wire and a second power wire; wherein at least one logical AND circuit is provided between the first power wire and the second power wire; wherein the at least one logical AND circuit electrically is configured to connect the first power wire with the second power wire when the first power wire and the second power wire output high level voltages simultaneously; wherein the at least one logical AND circuit comprises a first transistor and a second transistor; wherein a control electrode of the first transistor is connected to the second power wire, a first electrode of the first transistor is connected to the first power wire, and a second electrode of the first transistor is connected to a first electrode of the second transistor; and wherein a control electrode of the second transistor is connected to the first power wire, and a second electrode of the second transistor is connected to the second power wire.

2. The power supply circuit according to claim 1, wherein the first transistor and the second transistor are N-type transistors.

3. The power supply circuit according to claim 1, wherein a voltage output from the power wire is switched between a high level and a low level.

4. The power supply circuit according to claim 1, wherein the first power wire and the second power wire are adjacent to each other.

5. The power supply circuit according to claim 4, wherein at least one logical AND circuit is provided between every two adjacent power wires.

6. The power supply circuit according to claim 1, wherein connection points connecting the at least one logical AND circuit with the first power wire and the second power wire are respectively located at positions on the first power wire and the second power wire relatively far from a power supply.

7. The power supply circuit according to claim 1, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

8. An array substrate comprising the power supply circuit according to claim 1.

9. A display device comprising an array substrate according to claim 8.

10. The power supply circuit according to claim 1, wherein connection points connecting the at least one logical AND circuit with the first power wire and the second power wire are respectively located at positions on the first power wire and the second power wire relatively far from a power supply.

11. The power supply circuit according to claim 2, wherein connection points connecting the at least one logical AND circuit with the first power wire and the second power wire are respectively located at positions on the first power wire and the second power wire relatively far from a power supply.

12. The power supply circuit according to claim 3, wherein connection points connecting the at least one logical AND circuit with the first power wire and the second power wire are respectively located at positions on the first power wire and the second power wire relatively far from a power supply.

13. The power supply circuit according to claim 4, wherein connection points connecting the at least one logical AND circuit with the first power wire and the second power wire are respectively located at positions on the first power wire and the second power wire relatively far from a power supply.

14. The power supply circuit according to claim 5, wherein connection points connecting the at least one logical AND circuit with the first power wire and the second power wire are respectively located at positions on the first power wire and the second power wire relatively far from a power supply.

15. The power supply circuit according to claim 1, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

16. The power supply circuit according to claim 2, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

17. The power supply circuit according to claim 3, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

18. The power supply circuit according to claim 4, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

19. The power supply circuit according to claim 5, wherein a plurality of logical AND circuits are provided between the first power wire and the second power wire, and wherein a plurality of connection points connecting the plurality of logical AND circuits with the first power wire and the second power wire are provided on the first power wire and the second power wire at intervals.

* * * * *